US012781415B2

(12) United States Patent
Gunn et al.

(10) Patent No.: US 12,781,415 B2
(45) Date of Patent: Nov. 3, 2026

(54) SHIPPING BRACKET FOR A WASHING MACHINE APPLIANCE

(71) Applicant: Haier US Appliance Solutions, Inc., Wilmington, DE (US)

(72) Inventors: Tanner Davis Gunn, Louisville, KY (US); Christopher Gene Vowels, Cox's Creek, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 131 days.

(21) Appl. No.: 18/897,359

(22) Filed: Sep. 26, 2024

(65) Prior Publication Data

US 2026/0085464 A1 Mar. 26, 2026

(51) Int. Cl.
*D06F 39/00* (2020.01)

(52) U.S. Cl.
CPC ..... *D06F 39/001* (2013.01)

(58) Field of Classification Search
CPC ..... D06F 39/001
See application file for complete search history.

(56) References Cited

U.S. PATENT DOCUMENTS

| | | | | |
|---|---|---|---|---|
| 11,885,061 B2 | 1/2024 | Anburaj et al. | | |
| 2023/0287619 A1* | 9/2023 | Shinde | ..... | D06F 39/001 |

FOREIGN PATENT DOCUMENTS

| | | | | |
|---|---|---|---|---|
| CN | 212601348 U | 2/2021 | | |
| CN | 113089268 A | 7/2021 | | |
| DE | 19750513 A1 * | 5/1999 | ..... | D06F 39/001 |
| WO | WO2017/088778 A1 | 6/2017 | | |
| WO | WO-2018095206 A1 * | 5/2018 | ..... | B65D 61/00 |

OTHER PUBLICATIONS

Machine Translation of Li et al., WO-2018095206-A1, May 2018. (Year: 2018).*
Machine Translation of Hagedorn et al., DE-19750513-A1, May 1999. (Year: 1999).*

* cited by examiner

*Primary Examiner* — David G Cormier
(74) *Attorney, Agent, or Firm* — Dority & Manning, P.A.

(57) ABSTRACT

A washing machine appliance may include a cabinet. The cabinet may include a side panel and a rear panel. The washing machine appliance may include a subwasher disposed within the cabinet. The washing machine appliance may include a shipping bracket attached to the rear panel. The shipping bracket may include a main body and a clamp body. The main body may define a bolt aperture therethrough. The main body may include a lateral end. The clamp body may extend transversely from the lateral end. The clamp body may be in a parallel arrangement with the side panel. The washing machine appliance may include a shipping bolt removably disposed within the bolt aperture.

18 Claims, 10 Drawing Sheets

SHIPPING BRACKET FOR A WASHING MACHINE APPLIANCE

FIELD OF THE DISCLOSURE

The present subject matter relates generally to a washing machine appliance, and more particularly to shipping brackets for a washing machine appliance.

BACKGROUND OF THE DISCLOSURE

Washing machine appliances generally include a wash tub housed within a cabinet. A wash basket is rotatably mounted within the wash tub and defines a wash chamber for receipt of articles for washing during a wash cycle. During the wash cycle, the wash basket rotates and agitates articles or wash fluid to wash the articles. The wash tub may move or vibrate within the cabinet during the wash cycle. One or more suspension devices of the washing machine appliance may suspend the wash tub within the cabinet and allow some movement relative to the cabinet during operation. The suspension devices generally allow the tub to move relative to the cabinet during operation of the washing machine appliance.

A common method for handling packaged appliances, for instance, during shipping and handling, is clamp handling. Clamp handling can consist of a clamp truck utilizing two large metal blades to squeeze (e.g., clamp) packaged appliances. The clamp trucks can be required to transmit large amounts of force (e.g., approximately 2000 lbf) to the packaged appliances to handle or transport the packed appliance. Without proper support, the clamp force applied to the packaged appliances can be transferred directly to the appliance and deform or damage the appliances. For example, the clamp force can deform or damage the cabinet of the appliance.

Moreover, vibrations that may be experienced during the transportation of the washing machine appliance may overwhelm the suspension devices, resulting in premature wear or damage to one or more components of the appliance. Accordingly, shipping bolts and spacers are commonly used to secure the tub to the cabinet to limit motion of the subwasher and to ensure the safe handling of the washing machine appliance, for instance, during shipping or other transport. After the washing machine appliance is installed, the shipping bolts and spacers should be removed prior to operating the machine. However, sometimes the shipping bolts and spacers are inadvertently left in the washer at the time of installation. If these bolts and spacers are not removed, the suspensions of the wash tub will not be activated and there will be a lot of noise and vibration. These issues result in customer dissatisfaction, damage to the appliance or surrounding property, additional service visits, or increased maintenance costs.

Accordingly, features for a washing machine appliance that may obviate one or more of the above mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet. The cabinet may include a side panel and a rear panel. The washing machine appliance may include a subwasher disposed within the cabinet. The washing machine appliance may include a shipping bracket attached to the rear panel. The shipping bracket may include a main body and a clamp body. The main body may define a bolt aperture therethrough. The main body may include a lateral end. The clamp body may extend transversely from the lateral end. The clamp body may be in a parallel arrangement with the side panel. The washing machine appliance may include a shipping bolt removably disposed within the bolt aperture In another exemplary aspect of the present disclosure, a washing machine appliance is provided. The washing machine appliance may define vertical direction, a lateral direction, and a transverse direction. The washing machine appliance may include a cabinet. The cabinet may include a first side panel, a second side panel, and a rear panel. The first side panel and the second side panel may be spaced apart along the lateral direction. The washing machine appliance may include a subwasher disposed within the cabinet. The washing machine appliance may include a shipping bracket attached to the rear panel. The shipping bracket may include a first end and a second end. The first end and the second end may be spaced apart along the lateral direction. The shipping bracket may define a bolt aperture therethrough. The first end may be positioned proud to the first side panel. The second end may be positioned proud to the second side panel. The washing machine appliance may include a shipping bolt removably disposed within the bolt aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
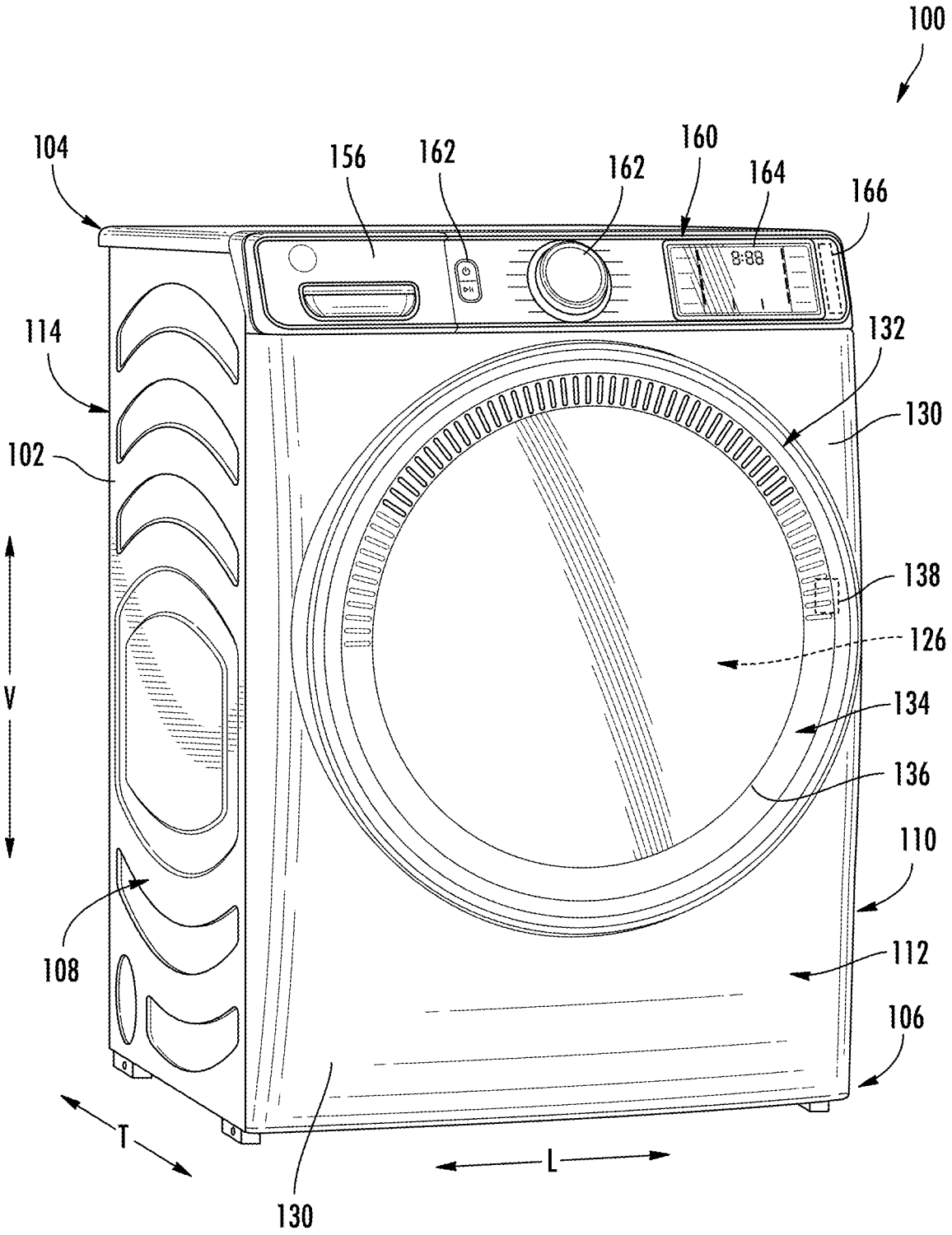
FIG. 1 provides a perspective view of a front load washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, reference to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Embodiments of the present subject matter provide shipping brackets for a washing machine appliance. Notably, the shipping brackets serve as clamp bars that can protect a cabinet of the washing machine appliance, for instance, during clamp handling of the washing machine appliance. In addition, the shipping brackets can facilitate securing the subwasher of the washing machine appliance, for instance, during shipping and handling of the washing machine appliance. Notably, the shipping brackets can advantageously reduce production cost, for instance, by reducing part count or reducing dunnage (e.g., disposable shipping components such as wooden clamp bars). In addition, the shipping brackets advantageously reduce or mitigate damage that may occur during clamp handling of the washing machine appliance.

Figure 2:
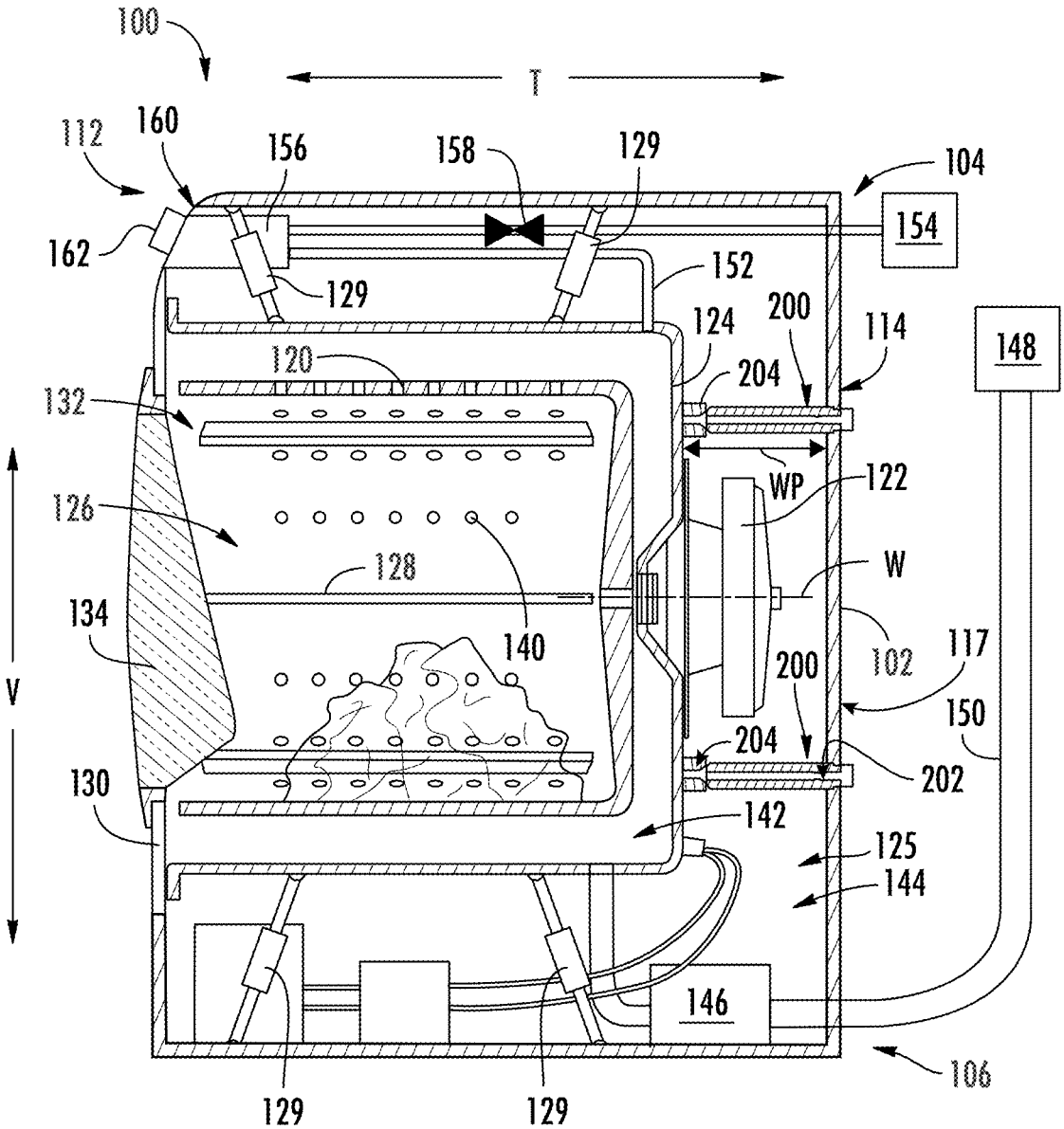
FIG. 2 provides a side cross section view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing or supporting various components of washing machine appliance 100 and which may also define one or more internal chambers or compartments of washing machine appliance 100. In this regard, as used herein, the terms "cabinet," "housing," or the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side panel 108 (e.g., the left side when viewed from the front as in FIG. 1) and a second side panel 110 (e.g., the right side when viewed from the front as in FIG. 1) along the lateral direction L, and between a front 112 and a rear panel 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation W. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

According to exemplary embodiments, wash tub 124 may be generally suspended within cabinet 102 by one or more suspension assemblies 129, e.g., as shown for example in FIG. 2. In this regard, wash tub 124, wash basket 120, motor 122, one or more suspension assemblies 129, and other components of washing machine appliance 100 may be referred to generally herein as a subwasher 125. In order to reduce the transmission of vibrations and other forces from the subwasher 125 to the cabinet 102 during operation of washing machine appliance 100, wash tub 124 may be generally isolated from cabinet 102 by suspension assemblies 129. This may be desirable to prevent undesirable noise, vibrations, "walking" of the appliance, etc. It should be appreciated that suspension assemblies 129 may generally include any suitable number and combination of springs, dampers, or other energy absorbing mechanisms to reduce the transmission of forces between the subwasher 125 and cabinet 102. Although exemplary suspension assemblies 129 are illustrated herein, it should be appreciated that the number, type, and configuration of suspension assemblies 129 may vary while remaining within the scope of the present subject matter.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (e.g., FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (e.g., FIG. 1) that is mounted to cabinet 102 or door 134 for selectively locking door 134 in the closed position or confirming that the door 134 is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, or other fluid additives, e.g., via spout 152 or detergent drawer 156. One or more valves (e.g., water supply valve 158) can be controlled by washing machine appliance 100 to provide for filling wash basket 120 to the appropriate level for the amount of articles being washed or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, or rinsed, the user can remove the articles from wash basket 120, e.g., by opening door 134 and reaching into wash basket 120 through opening 132.

In certain embodiments, control panel 160, with at least one input selector 162, extends from front 112. Control panel 160 and input selector 162 collectively form a user interface input for operator selection of machine cycles and features. A display 164 of control panel 160 indicates selected features, operation mode, a countdown timer, or other items of interest to appliance users regarding operation. Operation of washing machine appliance 100 may be controlled by a controller 166 connected (e.g., electrically coupled) to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100 (e.g., one or more sensors, such as a pressure sensor mounted to tub 121) may be in communication with controller 166 via one or more signal lines or shared communication busses.

Figure 3:
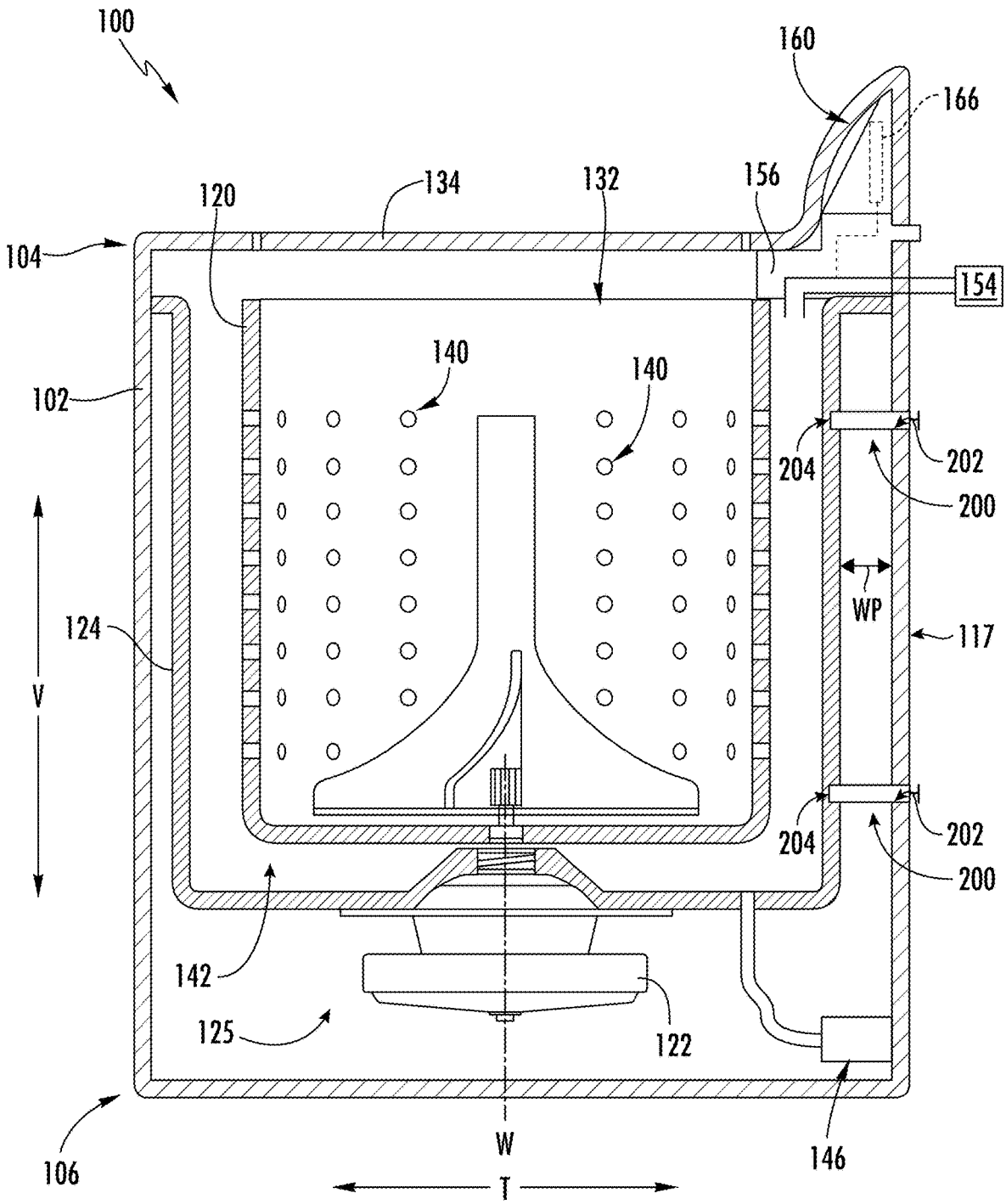
FIG. 3 provides a side cross section view of a top load washing machine appliance according to one or more exemplary embodiments of the present subject matter.
Figure 4:
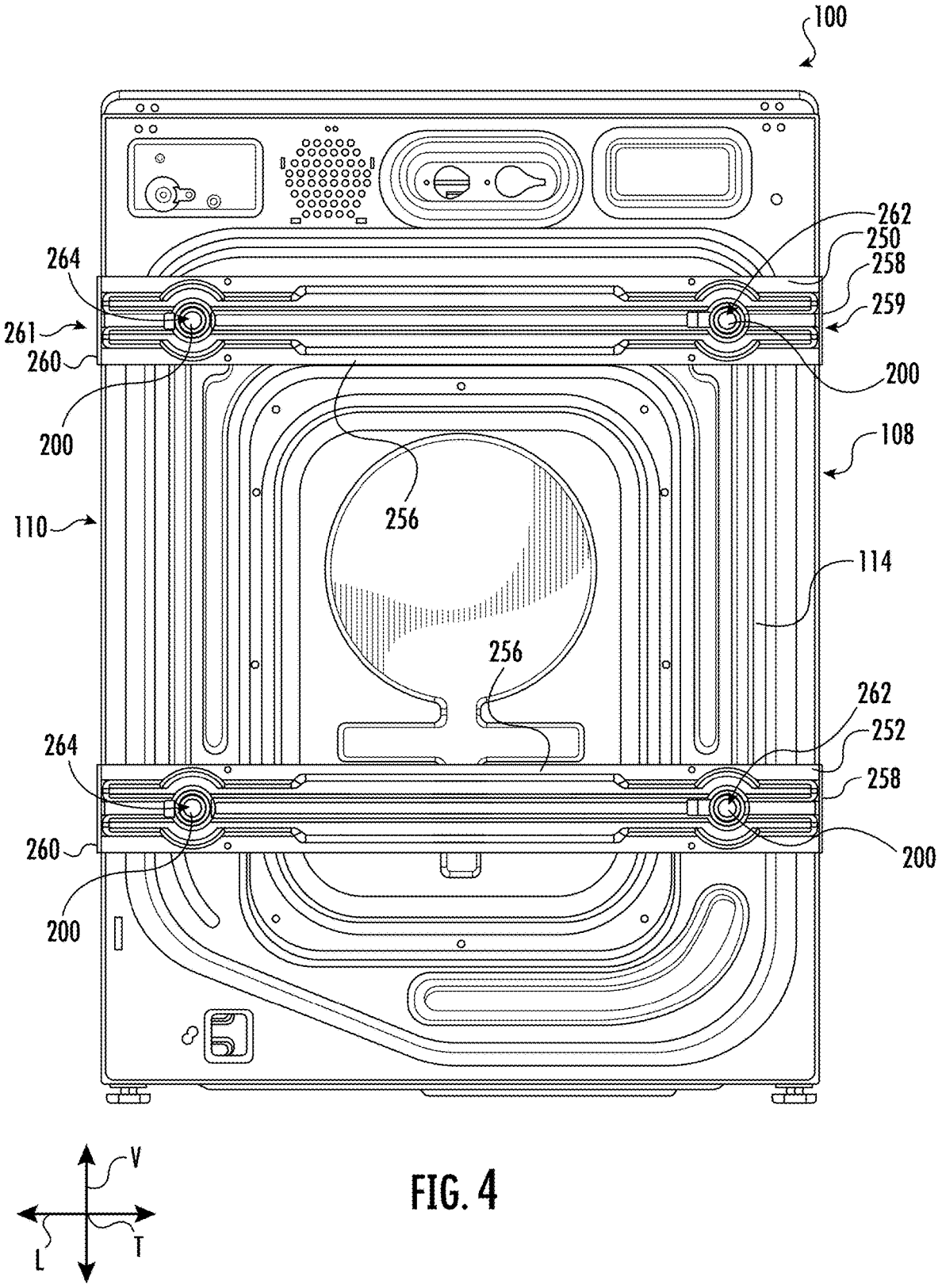
FIG. 4 provides a rear elevation view of a washing machine appliance according to one or more exemplary embodiments of the present subject matter.
Figure 5:
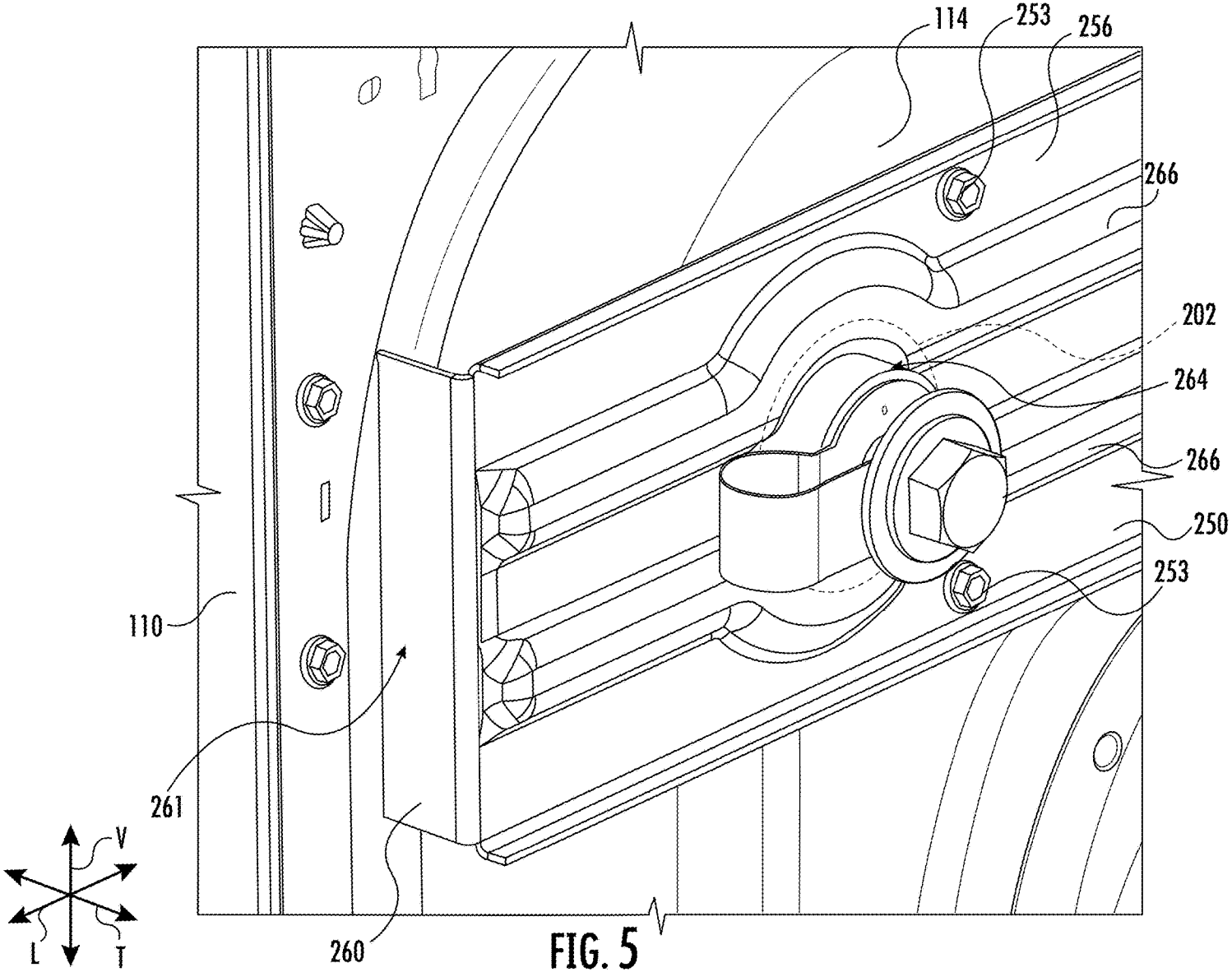
FIG. 5 provides a close-up perspective view of a shipping bracket attached to a rear panel of a washing machine appliance according to one or more exemplary embodiments of the present subject matter.
Figure 6:
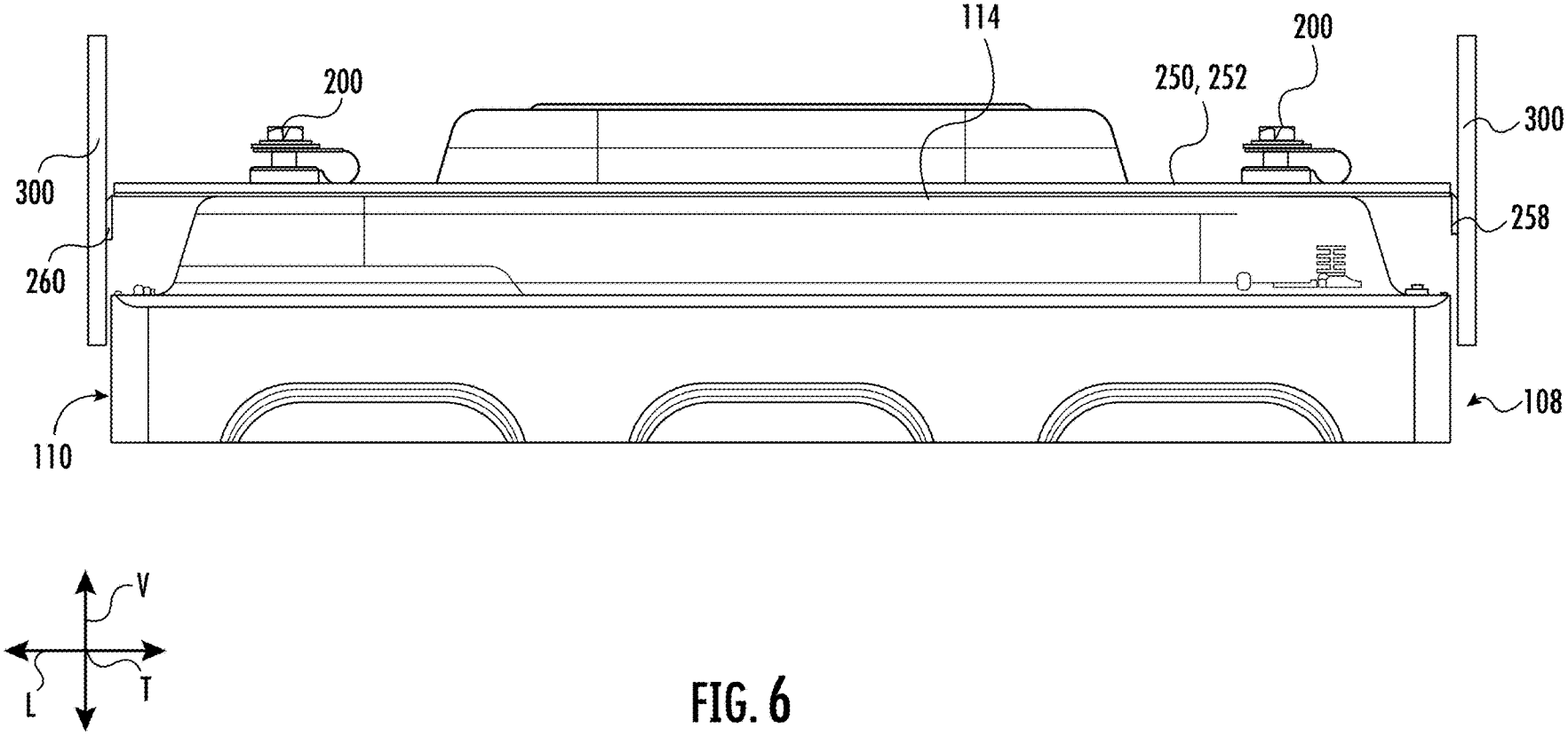
FIG. 6 provides a top view of a portion of a washing appliance according to one or more exemplary embodiments of the present subject matter.
Figure 7:
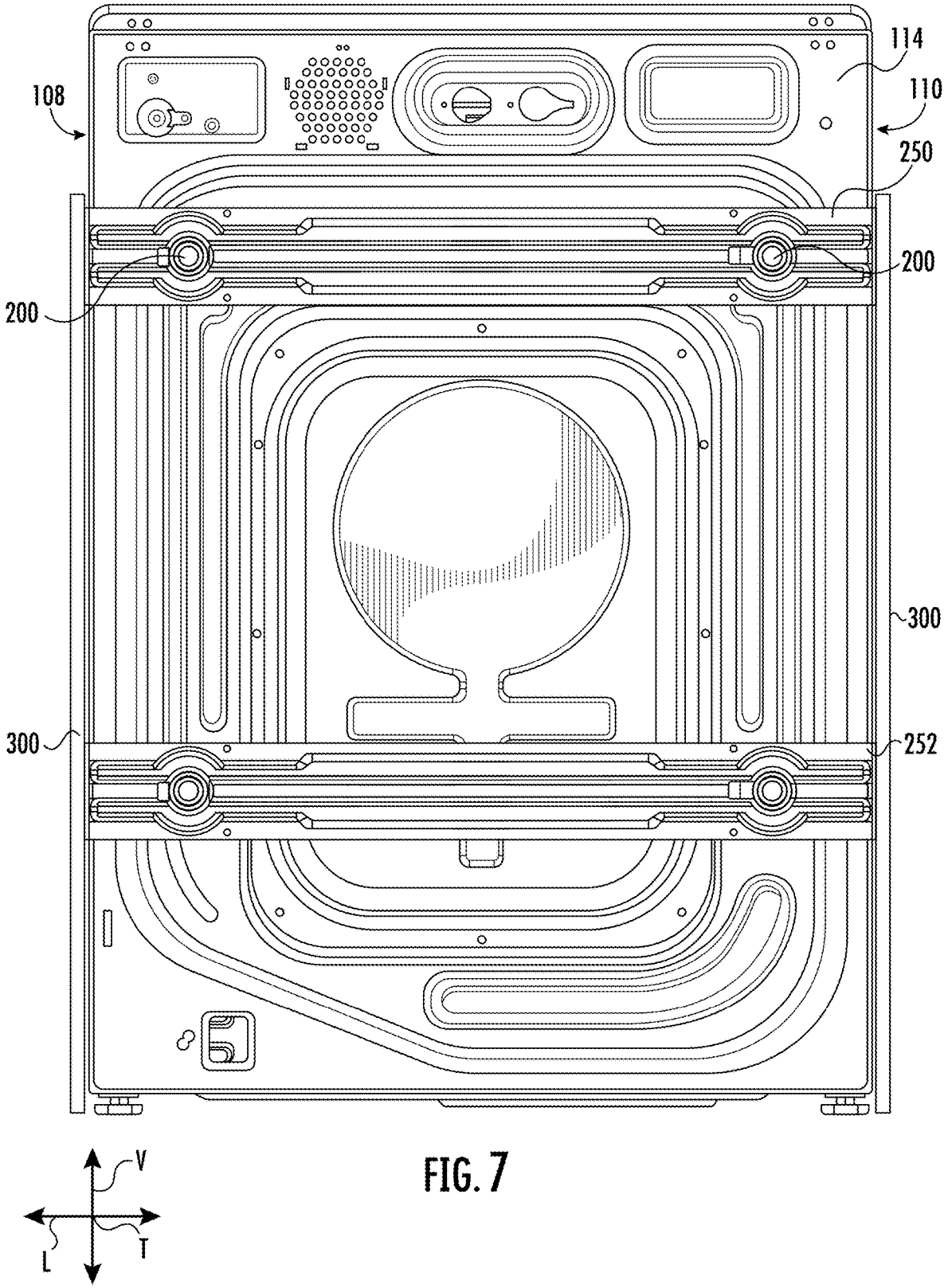
FIG. 7 provides a rear elevation view of a washing machine appliance according to one or more exemplary embodiments of the present subject matter.
Figure 8:
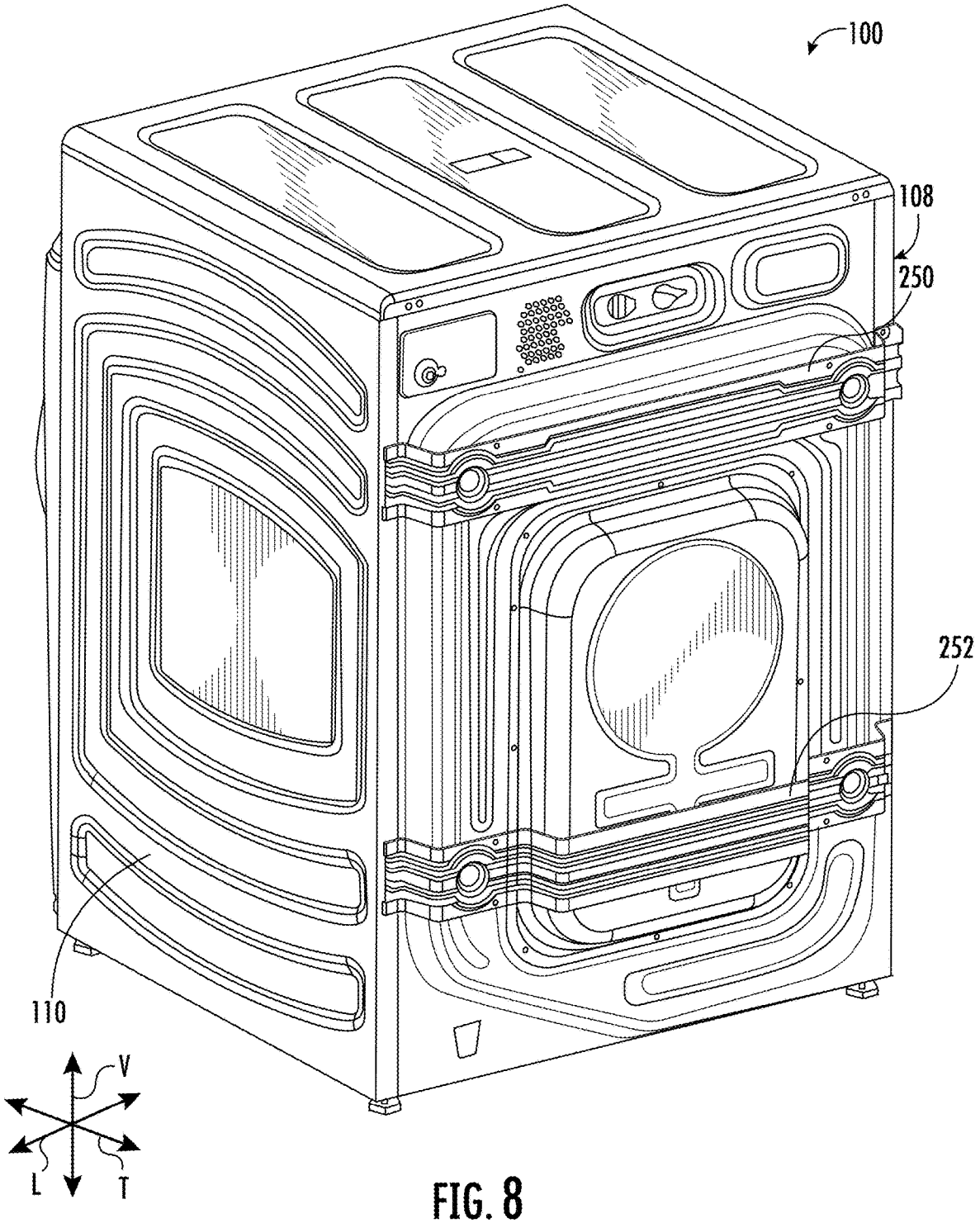
FIG. 8 provides a rear perspective view of a washing machine appliance according to one or more exemplary embodiments of the present subject matter.

FIG. 2 depicts a side section view of washing machine appliance 100 that is a front load washing machine. FIG. 3 depicts a side section view of a washing machine appliance that is a top load washing machine. Washing machine appliance 100 is shown in FIGS. 1 and 2 as a front loading washing machine, as an example. Other embodiments of a laundry appliance may also be used in embodiments, such as a top loading washing machine (as shown in FIG. 3), a dryer appliance, or another household appliance where stabilization during shipping may be beneficial. Generally, features of washing machine appliance 100 will be described below, with the understanding that other embodiments may include or be provided as another suitable household appliance (e.g., defining an internal chamber). In addition, it should be appreciated that like reference numerals may be used to refer to the same or similar features between the washing machine appliances 100 illustrated in FIGS. 1 through 3.

As shown in FIGS. 2 and 3, one or more shipping bolts 200 may be attached to wash tub 124. For instance, the rear panel 114 may define a spacer hole 202 extending therethrough, for instance, along the transverse direction T. The wash tub 124 may define a bolt boss 204 extending into wash tub 124. Generally, the shipping bolts 200 are removably attached to wash tub 124 for fixing a distance WP between wash tub 124 and cabinet 102 in an installed position. In some embodiments, the shipping bolts 200 attach to wash tub 124 by entering bolt boss 204, a portion of shipping bolts 200 extending between rear panel 114 and wash tub 124. In other words, a portion of shipping bolts 200 extends through spacer hole 202 and into bolt boss 204. Shipping bolts 200 may be configured to attach to wash tub 124 by removable receipt through spacer hole 202. Advantageously, fixing distance WP between wash tub 124 and cabinet 102 may allow the wash tub 124 to be rigidly fixed during transportation. Thus, preventing wear on suspension system 129 due to movement during transportation.

As will be appreciated in more detail below, the washing machine appliance 100 may include one or more shipping brackets attached to the rear panel 114 of the washing machine appliance 100. Notably, the shipping brackets advantageously provides a clamping surface for clamp handling of the washing machine appliance 100 and supports the rear panel 114 under the loads of restrained subwasher 125 via the shipping bolts 200, for instance, during shipping and handling of the washing machine appliance 100.

Referring now to FIGS. 4 through 10, a first shipping bracket 250 and a second shipping bracket 252 attached to the rear panel 114 of the washing machine appliance 100 are provided. For instance, one or more fasteners 253 (e.g., FIGS. 5 and 9) may be used to fastened the first shipping bracket 250 or the second shipping bracket 252 to the rear panel 114. As will be described in more detail below, the first shipping bracket 250 or the second shipping bracket 252 may be temporarily or permanently attached to the rear panel 114. The first shipping bracket 250 may be attached to an outer surface or face of the rear panel 114, for instance, proximate the top 104 of the washing machine appliance 100. As used herein "proximate the top 104" may refer to a position of a shipping bracket that is above the top fifty percent of the vertical height of the rear panel 114, for instance, such that the shipping bracket is closer to the top 104 of the washing machine appliance 100 than the bottom 106 of the washing machine appliance 100 (e.g., along the vertical direction V). The second shipping bracket 252 may be attached to an outer face or surface of the rear panel 114, for instance, proximate the bottom 106 of the washing machine appliance 100. As used herein "proximate the bottom 106" may refer to a position of the shipping bracket that is below the bottom fifty percent of the vertical height of the rear panel 114, for instance, such that the shipping bracket is closer to the bottom 106 of the washing machine appliance 100 than the top 104 of the washing machine appliance 100 (e.g., along the vertical direction V).

As briefly mentioned above, in some embodiments, the first shipping bracket 250 or the second shipping bracket 252 are temporarily attached to the outer surface or face of the rear panel 114. For instance, in such embodiments, the fasteners 253 may be temporary fasteners (e.g., fasteners that are intended to join two or more materials together and that have the ability to be removed). For example, the fasteners 253 may be configured as bolts, screws, or any other suitable temporary fasteners. In some other embodiments, the first shipping bracket 250 or the second shipping bracket 252 are permanently attached (e.g., fastened or affixed) to the rear panel 114 via one or more permanent fastening methods (e.g., single-use fastening or affixing methods that are intended to join two materials such that they cannot be removed once installed). For example, the fasteners 253 may be configured as, or replaced by, permanent fastening methods (e.g., rivets, welding, TOX®-clinching, or the like) that may permanently fastened or affix the first shipping bracket 250 or the second shipping bracket 252 to the rear panel 114.

In some embodiments (e.g., FIGS. 4 through 7), the first shipping bracket 250 or the second shipping bracket 252 define a generally straight or linear profile. In such embodiments, the shipping brackets extend generally along the length of the rear panel 114 of the cabinet 102, for instance, along the lateral direction L. Notably, the straight or linear profile of the first shipping bracket 250 or the second shipping bracket 252 may advantageously allow the same or similar shipping brackets to be proximate the top or proximate the bottom of the washing machine appliance. Thus advantageously reducing production costs for the first shipping bracket 250 or the second shipping bracket 252.

In some other embodiments (e.g., FIGS. 8 through 10), the first shipping bracket 250 or the second shipping bracket 252 are contoured to complement the shape or profile of the rear panel 114. For example, in such embodiments, the first shipping bracket 250 or the second shipping bracket 252 include bends that allow the first shipping bracket 250 or the second shipping bracket 252 to wrap around contours of the rear panel 114 such that the first shipping bracket 250 or the second shipping bracket 252 complement the shape or profile of the rear panel 114. Notably, contouring the shape of the first shipping bracket 250 or the second shipping bracket 252 to the shape or profile of the rear panel 114 advantageously allows clamp loads to be better transferred throughout the first shipping bracket 250 or the second shipping bracket 252 (e.g., during clamp handling). In addition, contouring the shape of the first shipping bracket 250 or the second shipping bracket 252 to the shape or profile of the rear panel 114 may advantageously provide a lower or more discrete profile to the first shipping bracket 250 and the second shipping bracket 252 relative to the rear panel 114 (e.g., when compared to existing shipping brackets). Additionally, in such embodiments, one or more auxiliary fastener holes 255 may be defined through the first shipping bracket 250 or the second shipping bracket 252. In this regard, it can be ensured that all portions of the first shipping bracket 250 and the second shipping bracket 252 are secured to the rear panel 114, for instance, during shipping and handling or during normal operation.

The first shipping bracket 250 or the second shipping bracket 252 may include a main body 256, a first clamp body 258, and a second clamp body 260. The main body 256 may extend between a first end 259 and a second end 261, for instance, along the lateral direction L. The main body 256 may define one or more bolt apertures for receiving the shipping bolts 200 that may secure the wash tub 124 to the cabinet 102 for safe handling of the washing machine appliance 100 during shipping or other transport. For instance, the main body 256 may define a first bolt aperture 262 and a second bolt aperture 264 therethrough. In addition, the first bolt aperture 262 and the second bolt aperture 264 may each be aligned with corresponding spacer holes 202 for receiving shipping bolts 200. Notably, the first shipping bracket 250 or the second shipping bracket 252 may advantageously reinforce the rear panels 114, for instance, at the spacer holes 202. In particular, the first shipping bracket 250 or the second shipping bracket 252 may add additional structure at locations where the shipping bolts 200 may engage with the cabinet 102. Thus, damage to the rear panel 114, for instance, at or proximate to the spacer holes 202, may be prevented or mitigated.

In some embodiments, the first bolt aperture 262 is positioned proximate to the first end 259 of the main body 256. That is, the first bolt aperture 262 may be positioned at or within close proximity to the first end 259 of the main body 256, such as closer to the first end 259 than the second end 261 along the lateral direction L. In some embodiments, the second bolt aperture 264 is positioned proximate to the second end 261 of the main body 256. That is, the second bolt aperture 264 may be positioned at or within close proximity to the second end 261 of the main body 256, such as closer to the second end 261 than the first end 259 along the lateral direction L.

The first shipping bracket 250 or the second shipping bracket 252 may include one or more features that advantageously brace, or provide rigidity to, the first shipping bracket 250 or the second shipping bracket 252, for instance, for clamp handling of the washing machine appliance 100. As used herein "clamp handling" or the like may generally refer to a method of moving packaged appliances (e.g., packaged washing machine appliances) via machinery (e.g., clamp trucks) that utilize horizontally moving arms, or clamps, to secure the packaged appliance and lift it off the ground. In some embodiments, the first clamp body 258 and the second clamp body 260 extend transversely from the first end 259 and the second end 261, respectively, such that the first clamp body 258 and the second clamp body 260 are in a parallel arrangement with the first side panel 108 and the second side panel 110, respectively. For example, the first clamp body 258 and the second clamp body 260 may be configured as a flange or a form that extends transversely from the first end 259 and the second end 261, respectively.

In some embodiments (e.g., FIGS. 4 through 7), the first clamp body 258 and the second clamp body 260 may extend transversely forward (e.g., to or toward the front of the washing machine appliance 100 along the transverse direction T) from the first end 259 and the second end 261, respectively. In some other embodiments, (e.g., FIGS. 8 through 10), the first clamp body 258 and the second clamp body 260 may extend transversely rearward (e.g., away from the front of the washing machine appliance 100 along the transverse direction T) from the first end 259 and the second end 261, respectively. Notably, the first clamp body 258 and the second clamp body 260 may be positioned relative to the first side panel 108 and the second side panel 110, respectively, such that the first clamp body 258 and the second clamp body 260 are provided as the primary or initial load bearing members (e.g., a load bearing member that receives fifty percent or more of the load applied to packaged appliance during clamp handling or a load bearing member that receives the initial clamping force during clamp handling).

As should be appreciated, the first clamp body 258 or the second clamp body 260 may be positioned "flush to proud" with the first side panel 108 or the second side panel 110, respectively. In other words, the first shipping bracket 250 or the second shipping bracket 252 may be constructed or manufactured such that when attached to the rear panel 114 the first clamp body 258 or the second clamp body 260 are either flush with the first side panel 108 or the second side panel 110 (e.g., FIGS. 8 through 10), respectively, or proud to (e.g., offset or raised from along the lateral direction L) the first side panel 108 or the second side panel 110 (e.g., FIGS. 4 through 7), respectively. Notably, the positioning of the first clamp body 258 or the second clamp body 260 relative to the cabinet 102 may allow the shipping bracket to engage (e.g., directly or indirectly) with clamp arms 300 during clamp handling of the packaged washing machine appliance 100. Thus, the first shipping bracket 250 or the second shipping bracket 252 may advantageously prevent or mitigate deformation or damage to the cabinet 102 that may occur when proper clamping support is not present. In addition, the first shipping bracket 250 or the second shipping bracket 252 may eliminate the need for additional packaging materials (e.g., wooden bars) that existing packaged washing machine appliances utilize during clamp handling. In this regard, the first shipping bracket 250 or the second shipping bracket 252 may advantageously reduce cost and unnecessary use of disposable packaging materials.

Figure 9:
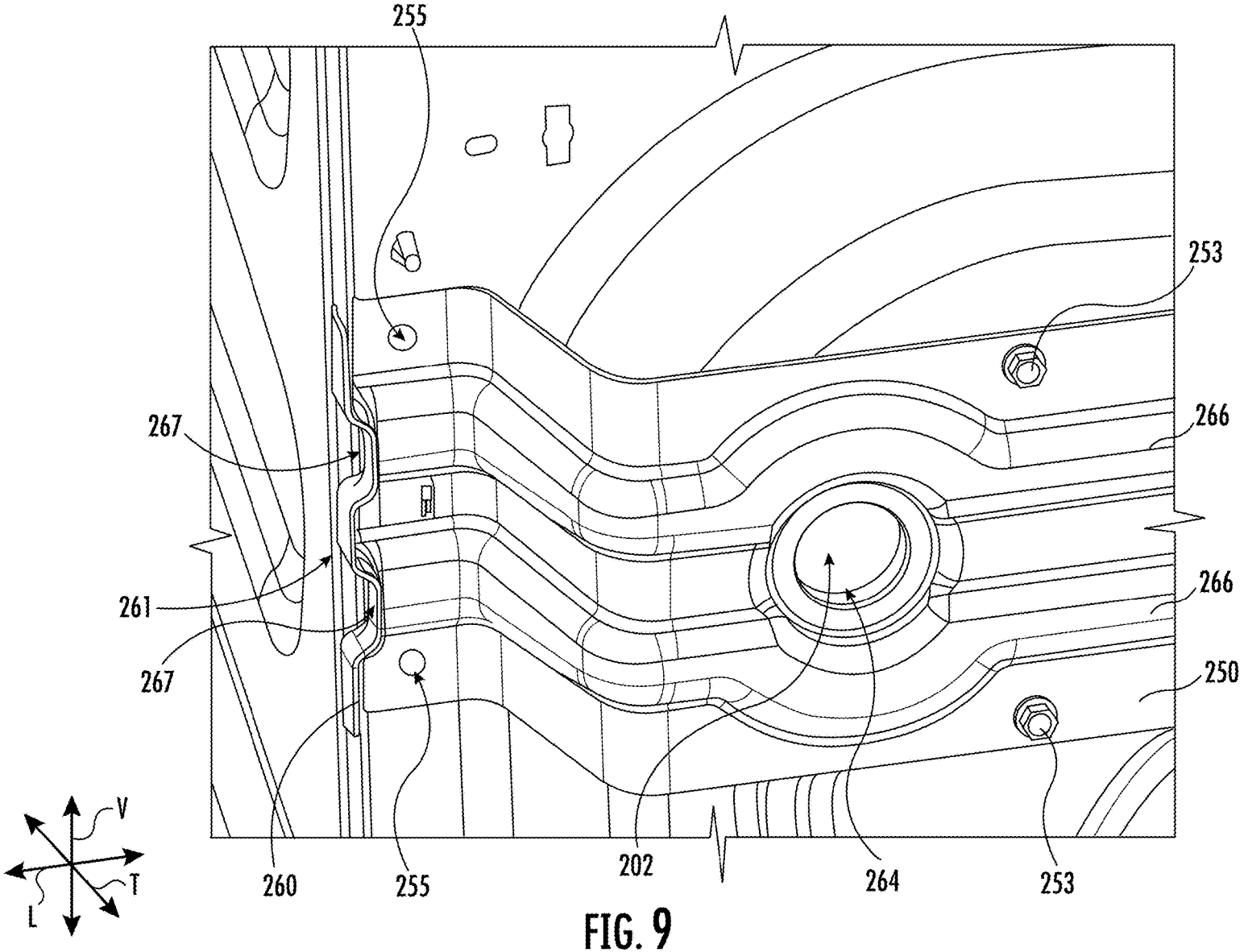
FIG. 9 provides a close-up perspective view of a shipping bracket attached to a rear panel of a washing machine appliance according to one or more exemplary embodiments of the present subject matter.
Figure 10:
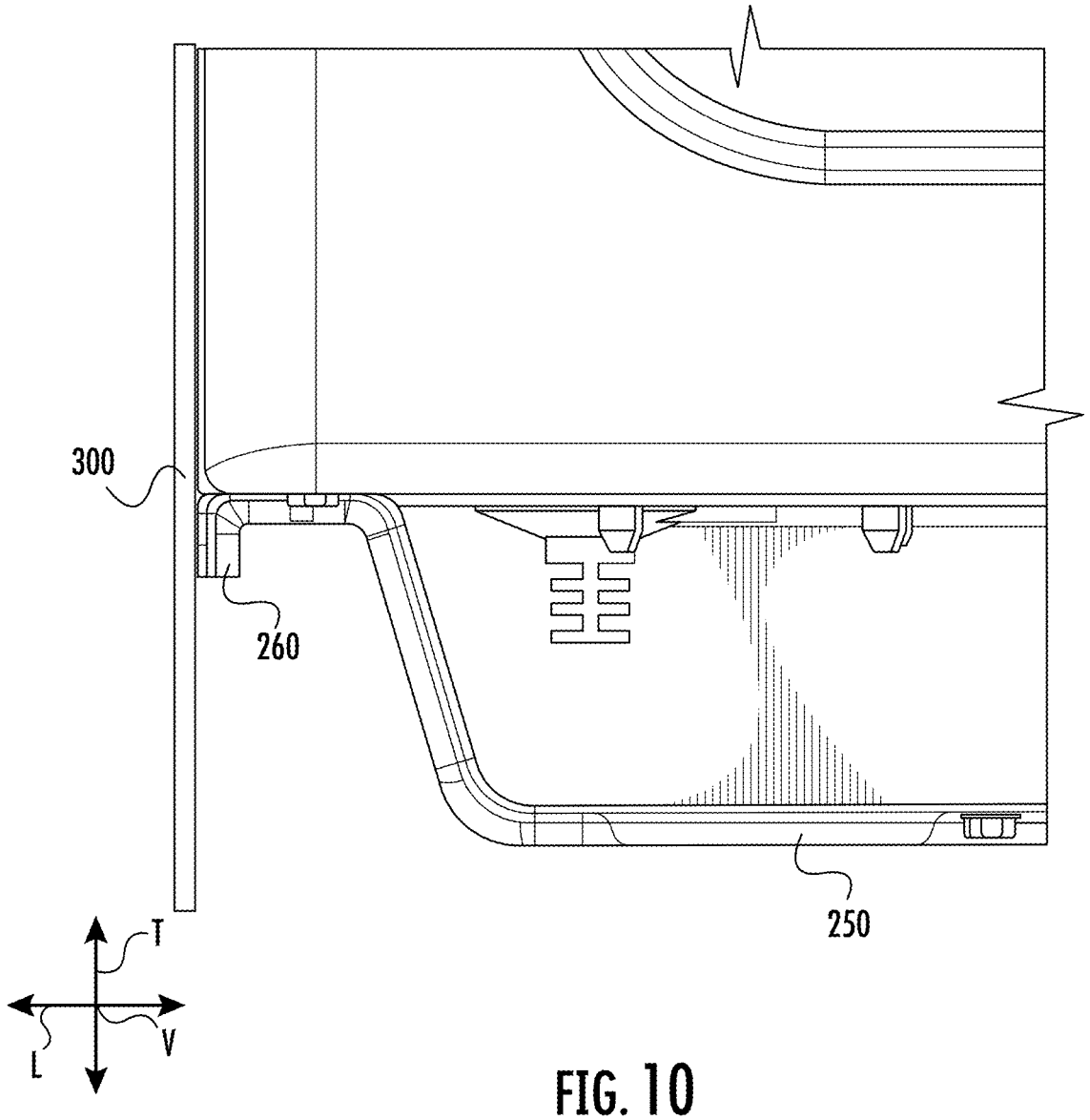
FIG. 10 provides a top view of a portion of a washing appliance according to one or more exemplary embodiments of the present subject matter.

Additionally, the first shipping bracket 250 or the second shipping bracket 252 may include one or more stiffening ribs 266 that extend along a length of the first shipping bracket 250 or the second shipping bracket 252. Notably, the stiffening ribs 266 may provide rigidity to the first shipping bracket 250 or the second shipping bracket 252, for instance, to prevent buckling under a load that may be applied to the first shipping bracket 250 or the second shipping bracket 252 during clamp handling. The stiffening ribs 266 may be embossed, pressed, or printed into the first shipping bracket 250 or the second shipping bracket 252. The stiffening ribs 266 may advantageously increase a lateral strength of the first shipping bracket 250 or the second shipping bracket 252. In some embodiments, the stiffening ribs 266 may extend into the first clamp body 258 and the second clamp body 260 to provide structural portions 267 of the first clamp body 258 or the second clamp body 260. For example, as illustrated in FIG. 9, the stiffening ribs 266 may define one or more structural portions 267 of the second clamp body 260. Notably, the structural portions 267 defined at the first clamp body 258 or the second clamp body 260 may increase the strength of the first clamp body 258 or the second clamp body 260 (e.g., when compared to clamp bodies that do not include the additional structural portions).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a side panel and a rear panel;

a subwasher disposed within the cabinet;

a shipping bracket attached to the rear panel, the shipping bracket comprising a main body and a clamp body, the main body defining a bolt aperture therethrough, the main body comprising a lateral end, the clamp body extending transversely from the lateral end, the clamp body being in a parallel arrangement with the side panel and positioned laterally outward of the side panel; and a shipping bolt removably disposed within the bolt aperture.

2. The washing machine appliance of claim 1, wherein the clamp body extends transversely forward from the main body.

3. The washing machine appliance of claim 1, wherein the clamp body extends transversely rearward from the main body.

4. The washing machine appliance of claim 1, wherein the shipping bracket further comprises one or more temporary fasteners for removably attaching the shipping bracket to the rear panel.

5. The washing machine appliance of claim 1, wherein the shipping bracket further comprises one or more permanent fasteners for permanently attaching the shipping bracket to the rear panel.

6. The washing machine appliance of claim 1, wherein the shipping bracket is a first shipping bracket, wherein the washing machine appliance further comprises a second shipping bracket attached to the rear panel, and wherein the first shipping bracket is positioned above the second shipping bracket.

7. The washing machine appliance of claim 1, wherein the shipping bracket further comprises one or more stiffening ribs extending along a length of the shipping bracket.

8. The washing machine appliance of claim 7, wherein the one or more stiffening ribs extended into the clamp body to define one or more structural portions within the clamp body.

9. The washing machine appliance of claim 1, wherein the subwasher comprises a bolt boss extending into the subwasher, and wherein the shipping bolt is received within the bolt boss.

10. A washing machine appliance defining a vertical direction, a lateral direction, and a transverse direction, the washing machine appliance comprising:

a cabinet comprising a first side panel, a second side panel, and a rear panel, the first side panel and the second side panel being spaced apart along the lateral direction;

a subwasher disposed within the cabinet;

a shipping bracket attached to the rear panel, the shipping bracket comprising a first end and a second end, the first end and the second end being spaced apart along the lateral direction, the shipping bracket defining a bolt aperture therethrough, the first end being positioned laterally outward of the first side panel, the second end being positioned laterally outward of the second side panel; and a shipping bolt removably disposed within the bolt aperture.

11. The washing machine appliance of claim 10, wherein the shipping bracket comprises a first clamp body and a second clamp body, wherein the first clamp body extends from the first end along the transverse direction, wherein the first clamp body is in a parallel arrangement with the first side panel, wherein the second clamp body extends from the second end along the transverse direction, and wherein the second clamp body is in a parallel arrangement with the second side panel.

12. The washing machine appliance of claim 11, wherein the shipping bracket further comprises one or more stiffening ribs extending along a length of the shipping bracket.

13. The washing machine appliance of claim 12, wherein the one or more stiffening ribs extended into the first clamp body or the second clamp body to define one or more structural portions within the first clamp body or the second clamp body.

14. The washing machine appliance of claim 11, wherein the first clamp body extends forward from the first end along the transverse direction, and wherein the second clamp body extends forward from the second end along the transverse direction.

15. The washing machine appliance of claim 11, wherein the first clamp body extends rearward from the first end along the transverse direction, and wherein the second clamp body extends rearward from the second end along the transverse direction.

16. The washing machine appliance of claim 10, wherein the shipping bracket further comprises one or more temporary fasteners for removably attaching the shipping bracket to the rear panel.

17. The washing machine appliance of claim 10, wherein the shipping bracket further comprises one or more permanent fasteners for permanently attaching the shipping bracket to the rear panel.

18. The washing machine appliance of claim 10, wherein the subwasher comprises a bolt boss extending into the subwasher, and wherein the shipping bolt is received within the bolt boss.

* * * * *